United States Patent [19]

Greenwood

[11] 4,182,937

[45] Jan. 8, 1980

[54] MECHANICALLY BIASED SEMICONDUCTOR STRAIN SENSITIVE MICROPHONE

[75] Inventor: John C. Greenwood, Harlow, England

[73] Assignee: International Standard Electric Corp., New York, N.Y.

[21] Appl. No.: 944,425

[22] Filed: Sep. 21, 1978

[51] Int. Cl.[2] ..... H04R 17/02; H04R 21/02

[52] U.S. Cl. ..... 179/110 B; 73/777; 338/4; 357/26

[58] Field of Search ..... 179/100.41 T, 110 B, 179/110 D, 121 R, 138; 73/777; 338/4, 2; 357/26

[56] References Cited

U.S. PATENT DOCUMENTS 3,383,475 5/1968 Wiggins ..... 179/110 B

*Primary Examiner*—George G. Stellar

*Attorney, Agent, or Firm*—John T. O'Halloran; Jeffrey P. Morris

[57] ABSTRACT

A piezo-electric transducer element is disclosed which is formed by selected etchings from boron doped silicon. The transducer includes a diaphragm and a spring lever adapted to bias the transducer element into a state of strain so that a vibration of the diaphragm is transmitted to the transducer element. The transducer element is particularly suitable for use in a telephone microphone.

6 Claims, 5 Drawing Figures

Fig. 1
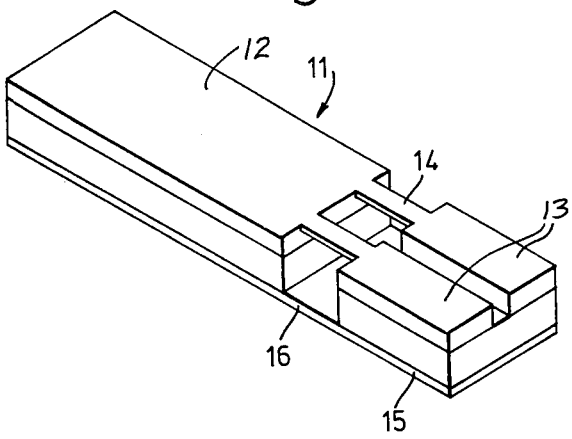
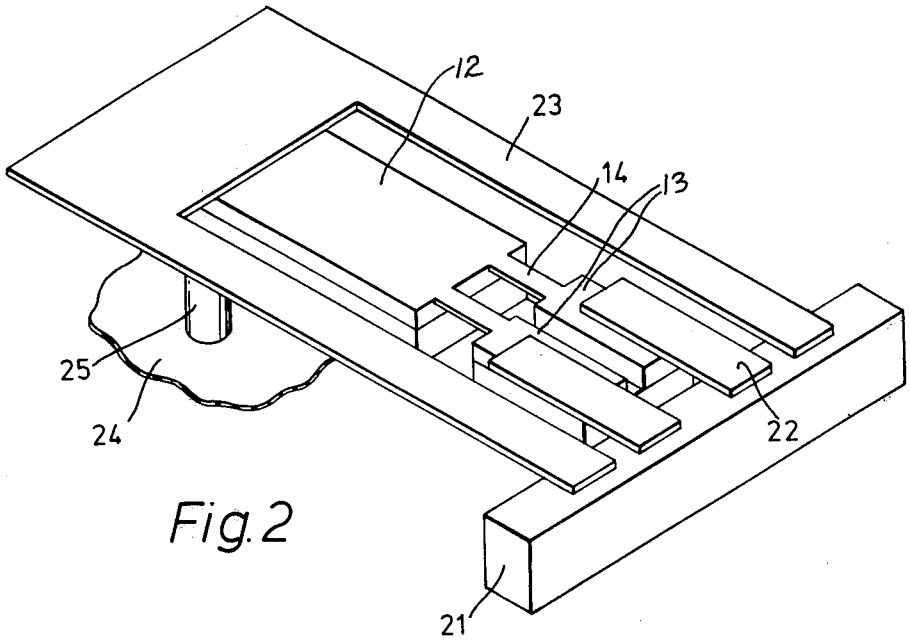
Fig. 2

MECHANICALLY BIASED SEMICONDUCTOR STRAIN SENSITIVE MICROPHONE

BACKGROUND OF THE INVENTION

This invention relates to electro-acoustic transducers, and in particular to a microphonic transducer in which the active element is a silicon cantilever.

SUMMARY OF THE INVENTION

According to one aspect of the invention there is provided a microphone transducer element of the type in which acoustic vibration generates corresponding resistance changes, including two or more semiconductor plate members mounted on an integral flexible laminar support and interconnected via one or more semiconductor filaments, the one or more filaments providing the strain sensitive elements of the transducer.

According to another aspect of the invention there is provided a microphone assembly, including a housing in which a flexible diaphragm is mounted, a semiconductor strain gauge transducer element secured to the housing by first and second contact springs, a spring lever mounted on the housing adjacent the contact springs and adapted to bias the transducer element into a state of strain, and a fulcrum pin mounted on the diaphragm and in abutment with the spring lever whereby acoustic vibrations of the diaphragm are transmitted to the transducer element.

BRIEF DESCRIPTION OF THE DRAWINGS

An embodiment of the invention will now be described with reference to the accompanying drawing wherein:

FIG. 1 shows a silicon transducer element of the cantilever type in accordance with the invention;

FIG. 2 is a schematic view of a microphone assembly using the transducer of FIG. 1;

DESCRIPTION OF THE PREFERRED EMBODIMENT

Figure 3:
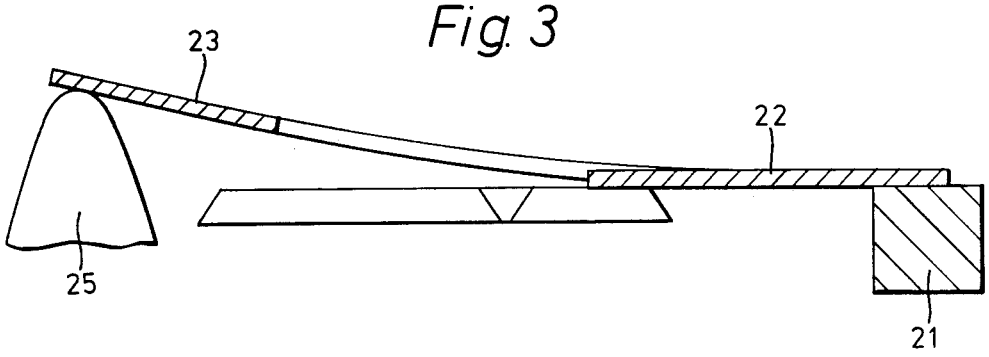
FIGS. 3 and 4 show the operation of the microphone assembly of FIG. 2.

Referring to FIG. 1, the transducer element 11 is a monolithic silicon structure made from a wafer of n-type silicon by a doping with a p-type dopant followed by a selective etching process, such as that described in our published British specification No. 1,211,499 (J. C. Greenwood 6), and comprises a plate member 12 coupled to a pair of smaller plate members 13 via silicon bridges or cantilevers 14. One face of the wafer is uniformly doped with the dopant, e.g. boron, while the other side is selectively doped through a mask to form the transducer pattern. When the slice is selectively etched, for example in a mixture of water, ethylene diamine and catechol, the uniformly doped one face of the wafer is not attacked but remains to form a flexible integral support plate 15. The undoped portions of the other face are etched away to form the transducer structure. In the finished structure the support plate 15 forms a hinge 16 between the large and small plate members thus allowing tension to be applied to the bridges 14.

As shown in FIG. 2 the transducer assembly is supported on a mounting block 21 via strip springs 22 and secured to a respective plate member 13, the springs 22 also providing electrical connection to the transducer. The mounting block 21 also carries a U-shaped spring 23 which spring abuts the large plate member 12 of the transducer and is slightly bent so as to bias the transducer maintaining the bridges 14 in tension.

Figure 4:
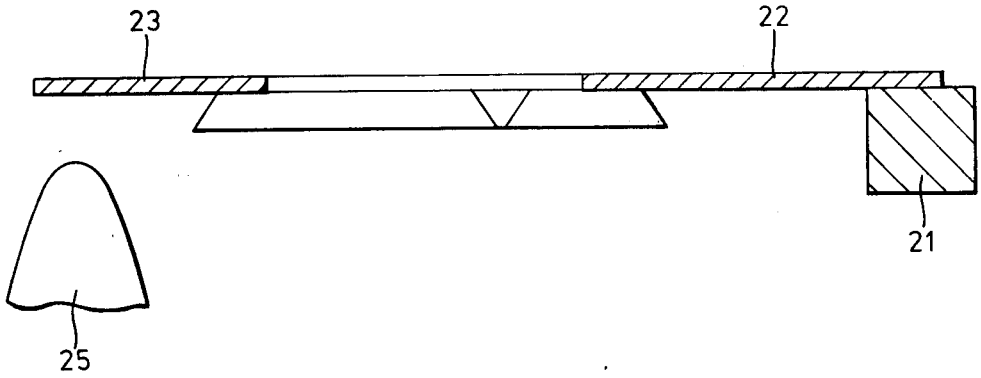

The central limb of the U-shaped spring is coupled to a diaphragm 24 via a fulcrum pin 25 fixed to the centre of the diaphragm and which abuts the spring 23. As shown in FIGS. 3 and 4 this arrangement provides a limiting action preventing overloadings of the transducer by excessive travel of the diaphragm. If the force exerted by the diaphragm is too large towards the transducer the spring 23 is pushed out of contact with the transducer 11 (FIG. 3). If the force is too large away from the diaphragm the fulcrum pin 25 loses contact with the spring 23 for a portion of its travel (FIG. 4).

In use, acoustic vibrations of the diaphragm cause corresponding vibrations of the transducer and hence variations in the strain of the bridge 14. The transducer output is measured as variations in the resistivity of the bridges.

The dimensions of the silicon bridge are chosen according to the desired sensitivity of the microphone assembly. Thus, for a microphone having a characteristic similar to that of a telephone carbon transmitter, the total volume of the bridges 14 should be $10^{-8}$ cc. The larger plate member of the transducer acrs as a lever, the dimensions of the lever and the stiffness of the bridges determining the stiffness of the transducer which, to match a carbon microphone should be $10^7$ dyne/cm. The electrical resistance of the device is determined by the resistivity of the silicone and this resistance is preferably between 50 and 200 ohm.

The distribution of boron in each bridge is non-uniform as it is diffused from one side, and this non-uniformity produces a corresponding strain or preload caused by a local reduction of the lattice constant of the silicon. Also the local boron concentration is somewhat higher than that required to produce the most advantageous electrical properties. The boron distribution in the bridges can be reduced in one of three ways.

1. Part of the diffused layer is removed with an etch so as to remove the more highly doped part.

2. The transducer is heat treated so that boron diffuses from the more highly doped regions to the lower doped ones thus giving a more uniform distribution. 3. The bridges are partially oxidized, the boron diffusing preferentially into the silica layer that is formed. The silica layer may be subsequently removed or it may be left in place to provide environmental protection.

A typical transducer element of this type has the overall dimensions of 3 mm by 1.5 mm and has bridges 3 micron thick, 20 microns wide and 100 microns long giving a total bridge volume of $1.2\times10^{-8}$ cc. The stiffness of a pair of such bridges is $22\times10$ dynes/cm. Thus, if the transducer element thickness is typically 250 microns, and it projects 2500 microns beyond the ends of the strip springs 24 giving a lever with a mechanical advantage of 10:1 the overall stiffness is $2.2\times10^7$ dynes/cm.

With such a construction the resistivity required to give a resistance of 100 ohms is $3\times10^{-3}$ ohm cm. This resistivity may be achieved with silicon doped with boron to a level of $10^{20}$ atoms/cc. The boron diffusion is made with a high surface concentration, e.g. $3\times10^{20}$ atoms/cc and to a depth of 6 microns. The silicon is then selectively etched. At the bridges half the 6 microns thickness is etched away leaving the lower doped portion and at the same time removing most of the dislocated surface material. In some applications the average doping level in the bridge may be lowered still further by thermal oxidation.

Figure 5:
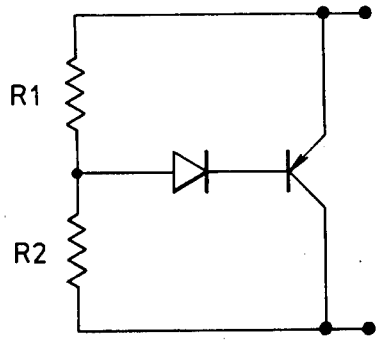
FIG. 5 shows the equivalent circuit of the transducer element of FIG. 1.

The equivalent circuit of the transducer element is shown in FIG. 5. The two silicon bridges 14 form resistors R1 and R2. On the fixed side of the transducer there are two p-type regions, formed by the plate members 13, separated by the n-type substrate and together forming a lateral transistor structure TR1 the base of which may be coupled to the resistors via a forward biased diode D1. The circuit is symmetrical, i.e. it is insensitive to polarity.

The transducer described herein has a pair of silicon bridges. In some applications a transducer with a single bridge may be employed. Although two bridges are preferred as this permits the electrical connections to be effected on the stationary portions of the transducer.

The crystal orientation of the transducer bridges is generally in the <110> direction as silicon wafers having this orientation are generally available. Improved output may however be obtained if the bridges are orientated in the <111> direction.

Various other arrangements may be employed for preventing overloading of the transducer by excessive excursions of a microphone diaphragm. Thus, in one application the diaphragm may be coupled to the transducer via a lever made of a strip of resilient material and having a shallow U-shaped cross section. Excessive travel of the diaphragm causes such a lever to 'snap' rather in the manner of a steel rule so as to prevent the application of excessive force to the transducer.

In a further arrangement the central portion of the diaphragm is contoured to form e.g. a Belleville spring. Under escessive loads such a diaphragm deforms so as to relieve the load.

We claim:

1. A microphone transducer element of the type in which acoustic vibration generates corresponding resistance changes, including:

at least two semiconductor plate members;

an integral flexible laminar semiconductor support upon which said plate members are situated; and at least one laminar semiconductor filament for interconnecting said plate members such that said at least one filament is strain-sensitive.

2. A transducer element as claimed in claim 1, further including means for maintaining said at least one filament in tension.

3. A transducer element as claimed in claim 1 wherein said semiconductor plate members are comprised of boron doped silicon.

4. A transducer element as claimed in claims 1, 2 or 3 wherein the resistance of said semiconductor is within the range of 50 to 200 ohm.

5. A microphone assembly comprising:

housing means;

flexible diaphrgam means mounted in said housing means;

semiconductor strain gauge transducer element; first and second contact springs for securing said transducer element to said housing;

spring lever means mounted on said housing proximate to said contact springs for biasing said transducer element into a state of strain; and fulcrum means mounted on said diaphragm and in abutment with the spring lever means such that acoustic vibrations of the diaphragm are transmitted to said transducer element.

6. In a telephone subscriber instrument, a microphone assembly comprising:

housing means;

flexible diaphragm means mounted in said housing means;

semiconductor strain gauge transducer element;

first and second contact springs for securing said transducer element to said housing;

spring lever means mounted on said housing proximate to said contact springs for biasing said transducer element into a state of strain; and fulcrum means mounted on said diaphragm and in abutment with the spring lever means such that acoustic vibrations of the diaphragm are transmitted to said transducer element.

* * * * *